US007435128B2

(12) United States Patent
Powell et al.

(10) Patent No.: US 7,435,128 B2
(45) Date of Patent: Oct. 14, 2008

(54) ULTRASONIC WELDED TELSPLICE STICK

(75) Inventors: James A. Powell, Winston-Salem, NC (US); Alexander Nestor, Winston-Salem, NC (US); David Erb, Harrisburg, PA (US); Leo Schuppert, Jr., York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 83 days.

(21) Appl. No.: 09/963,720

(22) Filed: Sep. 26, 2001

(65) Prior Publication Data

US 2003/0060076 A1 Mar. 27, 2003

(51) Int. Cl.
*H01R 4/24* (2006.01)

(52) U.S. Cl. ..... 439/403

(58) Field of Classification Search ..... 439/401, 439/403, 417, 442, 499, 874, 875, 402, 404–405, 439/719, 942; 29/825, 860, 861, 863, 857; 403/271–272; 228/1.1, 110.1; 156/73.1, 156/580.1

See application file for complete search history.

(56) References Cited

U.S. PATENT DOCUMENTS 3,708,779 A * 1/1973 Enright et al. ..... 439/392
3,910,453 A * 10/1975 Kneusel et al. ..... 220/260
4,047,784 A * 9/1977 Trank ..... 439/403
4,214,805 A * 7/1980 Faulconer ..... 439/392
4,252,397 A * 2/1981 Eigenbrode et al. ..... 439/405
4,717,360 A 1/1988 Czaja ..... 439/710
4,886,497 A * 12/1989 Scholl, Jr. ..... 604/111
4,973,263 A * 11/1990 Nielsen ..... 439/438
5,860,829 A * 1/1999 Hower et al. ..... 439/397
5,961,341 A * 10/1999 Knowles et al. ..... 439/403
5,989,057 A * 11/1999 Gerke et al. ..... 439/397
6,027,362 A * 2/2000 LaCroix ..... 439/404
6,254,421 B1 * 7/2001 Denovich et al. ..... 439/409
6,284,977 B1 * 9/2001 Boron et al. ..... 174/88 R
6,383,820 B1 * 5/2002 Bunn et al. ..... 436/518

* cited by examiner

*Primary Examiner*—Edwin A. León

(57) ABSTRACT

A telsplice stick device adapted to connect at least two electrical cables is provided. The telsplice connector includes a plurality of connectors, where each connector has opposing sides. At least one of the opposing sides of one connector is removably connected to one of the opposing sides of another connector by an ultrasonic weld. A crimping device is used with the telsplice stick, where the telsplice stick is inserted into the crimping device. At least one, but generally two or more cables are inserted into the telsplice connectors in the telsplice stick and spliced together.

20 Claims, 3 Drawing Sheets

FIG. 9

ULTRASONIC WELDED TELSPLICE STICK

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Certain embodiments of the present invention relate to telsplice connectors and more particularly to telsplice connectors joined together using ultrasonic welding to form a telsplice stick.

Plug-in circuit boards with electronic components thereon are widely used in the telecommunication and computer industries, among other industries. Generally, high speed data signals are conveyed to and from the circuit boards at a desired data rate using electrical cabling, wiring, connections or any other connection pathway (generally designated herein as "cable or cabling").

Joining individual cables together (commonly known as "splicing") is well known in the art. It is known to join, screw, clamp, compress or crimp the connectors onto the cable ends to join the cables. The cables are manually inserted onto the connecter and then the connector is screwed or crimped onto the cables generally using a tool such as a pair of pliers. Crimping tools are currently available that enable individual telsplice connectors to be individually inserted into the crimping tool before the cables are inserted into the telsplice connector. The crimping tool is manipulated so that telsplice connector is crimped onto the cables. It should be appreciated that this procedure is wasteful, costly and time intensive.

Different ideas have been employed to improve the splicing process. One idea includes using a semi-automatic crimping tool with a cartridge. Individual telsplice connectors are loaded into the cartridge and the cartridge is fed into the semi-automatic crimping tool. It should be appreciated that this procedure is again time intensive, requiring time to load the individual telsplice connectors into the cartridge. Further, this idea requires an additional cost to purchase the cartridge. Alternatively, the cartridges could be sold already loaded with telsplice connectors. It should be appreciated that, if the cartridge is removed before a whole sleeve of telsplice connectors are used, connectors may be lost.

Another approach includes loading telsplice connectors onto a tape, wherein the tape and connectors are inserted into the crimping tool. Loading individual connectors onto a tape is costly and time intensive. Furthermore, the tape may jam the crimping tool, again affecting work time and possibly damaging the machine.

It is desirable to provide a method for forming connectors that are removably connected. It is also desirable to provide connectors that are joined in a removable or breakable manner.

It is an object of at least one embodiment of the present invention to meet the foregoing needs and other objectives, which will become apparent from the detailed description, drawings and claims presented hereafter.

BRIEF SUMMARY OF THE INVENTION

In accordance with one embodiment of the present invention, a telsplice stick device adapted to connect at least two electrical cables is provided. The telsplice connector includes a plurality of connectors, where each connector has opposing sides. At least one of the opposing sides of one connector is removably connected to one of the opposing sides of another connector by an ultrasonic weld. A crimping device is used with the telsplice stick, where the telsplice stick is inserted into the crimping device. At least one, but generally two or more cables are inserted into the telsplice connectors in the telsplice stick and spliced together.

In accordance with another embodiment of the present invention, a method of forming a telsplice stick is provided. A plurality of connectors are formed, each connector having a nonconductive housing and at least two opposing sides. Each of the connectors is removably connected to an adjacent connector using an ultrasonic weld.

In yet another embodiment, a method of telsplicing electric cabling is provided. One end of at least one electric cable is inserted into a channel defined by at least one of a plurality of telsplice connectors forming a telsplice stick. The at least one telsplice connector is separated from the telsplice stick using a tool.

Further limitations and disadvantages of conventional and traditional approaches will become apparent to one of skill in the art, through comparison of such systems with the present invention as set forth in the remainder of the present application with reference to the drawings.

BRIEF DESCRIPTION OF SEVERAL VIEWS OF THE DRAWINGS

The foregoing summary, as well as the following detailed description of the embodiments of the invention, will be better understood when read in conjunction with the appended drawings. For the purpose of illustrating the invention, there is shown in the drawings, embodiments which are preferred. It should be understood, however, that the present invention is not limited to the precise arrangements and instrumentality shown in the attached drawings.

DETAILED DESCRIPTION OF THE INVENTION

Figure 1:
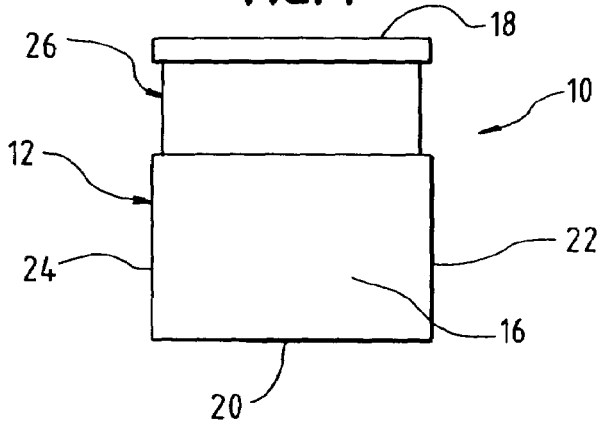
FIG. 1 illustrates a back elevational view of a telsplice connector formed in accordance with one embodiment of the present invention.
Figure 2:
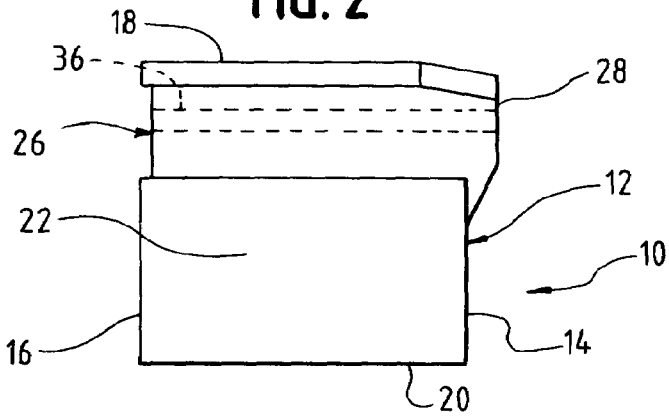
FIG. 2 illustrates a side elevational view of the telsplice connector of FIG. 1 formed in accordance with one embodiment of the present invention.

FIGS. 1 and 2 illustrate one embodiment of an individual telsplice connector formed in accordance with one embodiment of the present invention. In this illustrated embodiment, the telsplice connector, generally designated 10, has a housing 12 having opposing first and second engagement surfaces 14 and 16, respectively, opposing upper and lower surfaces 18 and 20, respectively, and opposing side surfaces 22 and 24, respectively. In one embodiment, the first and second engagement surfaces 14 and 16 define a first pair of planes and the upper and lower surfaces 18 and 20 define a second pair of planes perpendicular to the first pair of planes. Furthermore, the side surfaces 22 and 24 define a third pair of planes that are perpendicular to both the first and second pair of planes.

It should be appreciated that the terms upper, lower, front, back and side are designations used for discussion purposes only. These terms are assigned to distinguish surfaces on one plane of the telsplice connector from the surfaces on other planes. These terms are independent of the orientation of the telsplice connector. It is also appreciated that while a particular number of joined telsplice connectors are illustrated and discussed, any number of telsplice connectors is contemplated. Further, while the present invention is discussed with respect to a telsplice connector, any connector is contemplated.

FIGS. 1 and 2 also illustrate a crimping portion 26, which is adapted to engage a crimping device (not shown) enclosed in housing 12 discussed in greater detail below. In one embodiment, the crimping portion 26 is joined to and integral with upper surface 18 and adapted to move within housing 12 to engage the crimping device.

Figure 3:
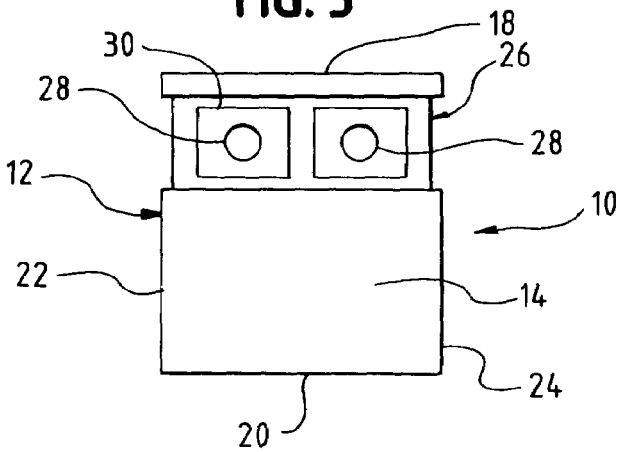
FIG. 3 illustrates a front elevational view of the telsplice connector of FIG. 1 formed in accordance with one embodiment of the present invention.

FIG. 3 illustrates the housing 12 defining at least one opening 28 in engagement surface 14. In particular, in one embodiment the crimping portion 26 defines two openings 28, having generally rectangular indents 30, which fluidly communicate with an interior channel 36 (shown in phantom in FIG. 2) as discussed below. The openings 28 are adapted to receive the electrical cables for securing and crimping therein. It should be appreciated that, while only two openings are illustrated, any number of openings 28 are contemplated.

Figure 4:
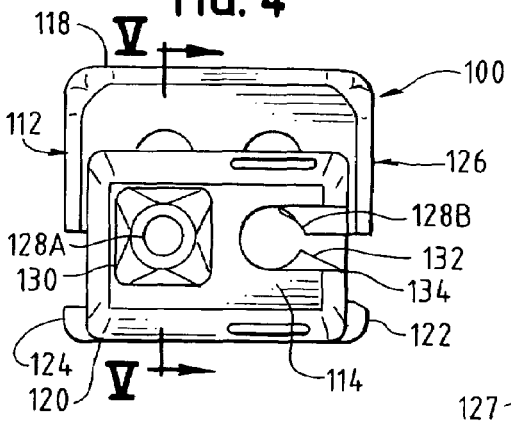
FIG. 4 illustrates a front elevational view of a second telesplice connector formed in accordance with one embodiment of the present invention.

FIG. 4 illustrates an elevational view of another embodiment of the telsplice connector, generally designated 100. In this embodiment, the telsplice connector 100 has a housing 112 and includes opposing upper and lower surfaces 118 and 120, first and second engagement surfaces 114 and 116 and opposing side surfaces 122 and 124 similar to the telsplice connector 10. However, in this embodiment, the telsplice connector 100 defines two openings 128 in first engagement surface 114 adapted to receive cabling. Opening 128A has a four-pronged indent 130, while first engagement surface 114 defines a cut 132 in side 134 proximate to and fluidly engaging second opening 128B.

Figure 5:
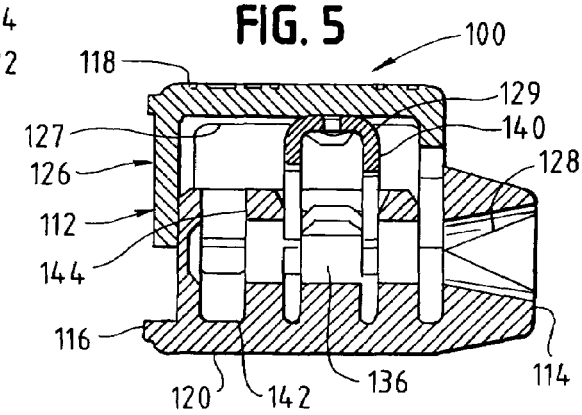
FIG. 5 illustrates an elevational cross-sectional view of the telsplice connector of FIG. 4 taken along line V-V of FIG. 4.

FIG. 5 illustrates an elevational cross-sectional view of the telsplice connector 100 of FIG. 4 taken along lines V-V. In the illustrated embodiment, the housing 112 defines an interior channel 136, which fluidly connects or communicates with openings 128. The interior channel 136 is adapted to receive the electrical cable therein through the opening 128.

The telesplice connector 100 further includes a crimping device 140, adapted to secure the electrical cable in interior channel 136. The crimping device 140 in this embodiment is placed adjacent to the interior channel 136 so that an upper portion 129 of the crimping device 140 is engaged by a lower surface 127 of the engaging portion 126. A connecting device or plate 142 is illustrated adjacent to the distal end 144 of channel 136. The connecting plate 142 is adapted to make an electrical connection between the one or more cables placed in the channel 136.

Figure 6:
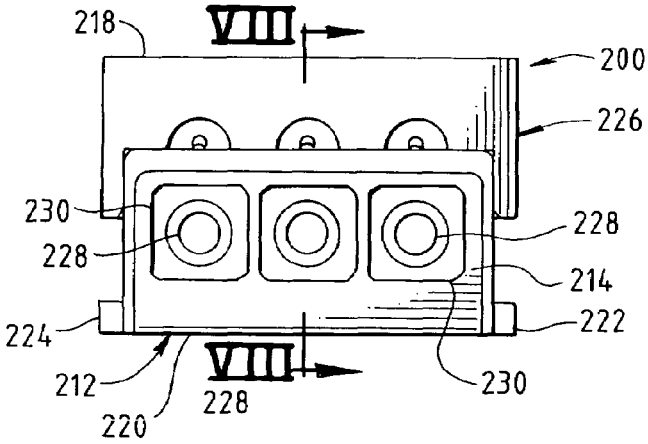
FIG. 6 illustrates a front elevational view of a third telesplice connector formed in accordance with one embodiment of the present invention.

FIG. 6 illustrates an elevational view of yet another embodiment of the telsplice connector, generally designated 200, similar to the telsplice connectors 10 and 100 illustrated in FIGS. 1-5. In this embodiment, the telsplice connector 200 has housing 212 and includes opposing upper and lower surfaces 218 and 220, first and second engagement surfaces 214 and 216 and opposing side surfaces 222 and 224 similar to the telsplice connectors 10 and 100. In this embodiment, the telsplice connector 200 defines three openings 228 adapted to receive the cabling. More particularly, first engagement surface 214 defines the openings 228, each opening having a corresponding indent 230.

Figure 7:
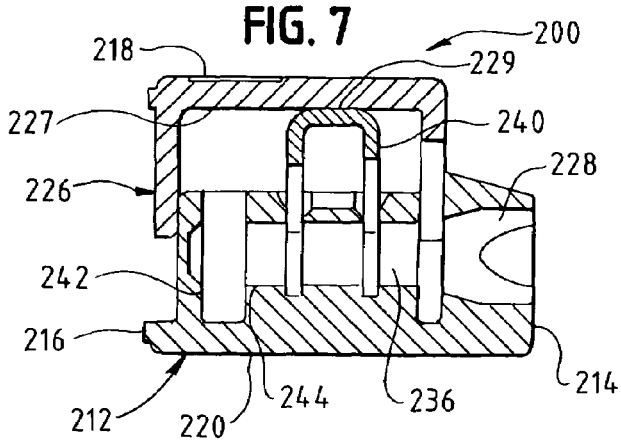
FIG. 7 illustrates an elevational cross-sectional view of the telsplice connector of FIG. 6 taken along lines VII-VII.

FIG. 7 illustrates an elevational cross-sectional view of the telsplice connector 200 of FIG. 6 taken along lines VII-VII. In the illustrated embodiment, the housing 212 defines an interior channel 236, which fluidly connects or communicates with each opening 228. The interior channel 236 is adapted to receive the electrical cable therein.

The telesplice connector 200 further includes a crimping device 240, adapted to secure an electrical cable in channel 236. The crimping device 240 in this embodiment is placed adjacent to the channel 236 so that the upper portion 229 of the crimping device 240 is engaged by the lower surface 227 of the engaging portion 226. A connecting device or plate 242 is illustrated adjacent the distal end 244 of channel 236. The connecting plate 242 is adapted to make an electrical connection between the one or more cables placed in the channel 236.

Figure 8:
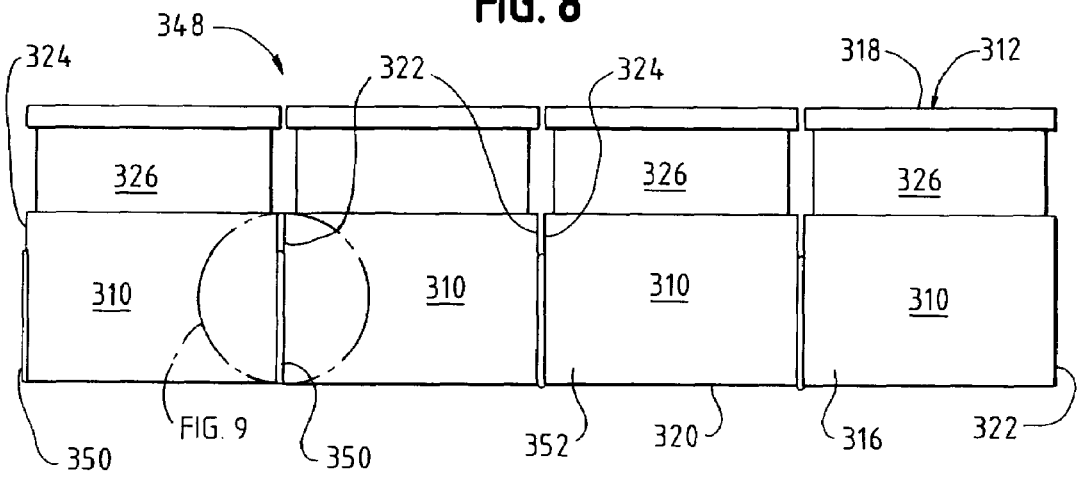
FIG. 8 illustrates a back elevational view of a telsplice stick formed in accordance with one embodiment of the present invention.

FIG. 8 illustrates one embodiment of a telsplice stick 348 in accordance with one embodiment of the present invention. In this embodiment, the telsplice stick 348 comprises at least two telsplice connectors 310 removably connected together. More specifically, in this embodiment a plurality of telsplice connectors 310 are removably connected or joined together by an ultrasound weld 350 forming the telsplice stick 348.

In one embodiment, the ultrasound weld 350 is placed at a lower outer corner 352 of one opposing side surface of each connector 310. It should be appreciated that other embodiments are contemplated. For example, the telsplice connecters 310 could be ultrasonically welded at a lower-inner or upper-outer corner for example. The weld 350 is adapted to join or connect at least one opposing side surface of each telsplice connector 310 to one opposing side surface of an adjacent telsplice connector 310 in a removable manner.

Figure 9:
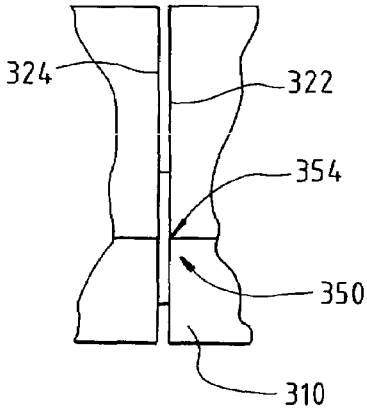
FIG. 9 illustrates an enlarged partial view of the telsplice stick of FIG. 8 formed in accordance with one embodiment of the present invention.

FIG. 9 illustrates an enlarged portion A of the weld section of the telsplice stick FIG. 8 as illustrated. In this embodiment, weld 350 is T-welded as is well known in the art. This weld is strong enough to hold the connectors together during shipping and insertion in the crimping tool but is sufficiently weak to break upon engagement by the crimping device.

It should be appreciated that many different materials are contemplated for the housing. In one embodiment, the telsplice connector housing is formed from a nonconductive material selected from a group consisting of polycarbonate, polyester and polypropylene. However, it should be appreciated that the telsplice connectors may be formed of all one material or different materials. For example, the housing may be made of polyester (or even metal) but covered by a polycarbonate film. Furthermore, the crimping portion may be made of polypropylene, but the remaining portion of the telsplice connector may be made of polycarbonate, depending on the application. Additionally, one or more connectors in the telsplice stick may be made of one nonconductive material, polyester for example, while the remaining telsplice connectors are made of different materials.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features that which come within the spirit and scope of the invention.

The invention claimed is:

1. A connector device comprising:

a first connector including a housing having opposing sides and a conductive connecting device mounted in the housing; and a second connector including a housing having opposing sides and a conductive connecting device mounted in the housing;

at least one of said opposing sides of said first connector being removably connected to one of said opposing sides of said second connector by an ultrasonic weld, whereby said first connector is separable from said second connector by breaking said ultrasonic weld such that said first connector forms an individual connector unit.

2. The connector device of claim 1, wherein said housings are formed of a polypropylene material.

3. The connector device of claim 1, where said first connector housing is timed of one nonconductive material and said second connector housing is formed of a second nonconductive material.

4. The connector device of claim 1, wherein said housings are formed of a nonconductive material.

5. The connector device of claim 4, wherein said housings are formed of a polycarbonate material.

6. The connector device of claim 4, wherein said housings are formed of a polyester material.

7. The connector device of claim 1, wherein said conductive connecting device in each of said housings is a crimping device adjacent to a channel defined in each of said housings.

8. The connector device of claim 7, wherein said first and second connectors further include a crimping portion capable of engaging said crimping device.

9. A connector stick device comprising:

a plurality of connectors;

each of said connectors including a conductive connecting device mounted in a housing having opposing sides; and wherein at least one of said opposing sides of each said connector is removably connected to one of said opposing sides of an adjacent said connector by an ultrasonic weld, and further wherein each said connector is separable from its adjacent said connector by breaking said ultrasonic weld to form an individual connector unit.

10. A connector stick device in accordance with claim 9 wherein said housings comprise first and second portions movable relative to one another.

11. A connector stick device in accordance with claim 9 wherein each said conductive connecting device comprises a crimping device.

12. A connector stick device in accordance with claim 9 wherein said housings each comprise a channel for receiving cabling, and a crimping device proximate said channel.

13. A connector stick device in accordance with claim 9 wherein said opposing sides are nonconductive.

14. A connector assembly for splicing cable with an automatic crimping tool, said connector assembly comprising:

a plurality of nonconductive housings joined to one another by respective ultrasonic welds to form a connector stick, each of said housings holding a conductive connecting device and having at least one opening for passage of electrical cabling to the conductive connecting device, wherein said plurality of joined nonconductive housings are separable from one another by breaking said respective ultrasonic welds as the cable is spliced to successive said conductive connecting devices along the connector stick, thereby forming a plurality of individual connector units.

15. A connector stick assembly in accordance with claim 14 wherein said housings each comprise a channel for receiving cabling, and a crimping device proximate said channel.

16. A connector stick assembly in accordance with claim 14 wherein said housings comprise first and second portions movable relative to one another.

17. A connector stick assembly in accordance with claim 16 wherein each said conductive connecting device comprises a crimping device.

18. A method for splicing cable to a plurality of connectors, said method comprising:

providing a plurality of individual connectors, each said connector including a housing, at least one cable opening, and at least one conductive crimping device proximate the opening;

joining the connectors to one another by respective ultrasonic welds to form a connector stick for splicing operations;

inserting cable into the openings of each of the joined connectors; and seeming the cable to each of the connectors using the conductive crimping device, wherein force generated in securing the cable to the respective connectors separates the respective connectors from the connector stick by breaking the respective ultrasonic welds, thereby forming a plurality of individual connector units each having cable spliced thereto.

19. A method for splicing cable to a plurality of connectors, said method comprising:

providing a plurality of individual connectors, each said connector including a first housing portion and a second housing portion movable relative to one another, a cable opening in one of the first and second housing portions, and a conductive crimping device in the other of the first and second housing portions;

bonding the connectors to one another with respective ultrasonic welds to form a connector stick for splicing operations;

inserting cable into an opening of one of the joined connectors; and breaking the ultrasonic weld between the one connector and an adjacent connector while securing the cable to the one connector using the conductive crimping device.

20. A stick of electrical connectors comprising:

a plurality of electrical connectors disposed side-by-side, each of said connectors including a conductive connecting device mounted in a non-conductive housing, said connectors being joined together by respective ultrasonic welds between adjacent said housings, wherein said connectors are individually separable from the stick by breaking said ultrasonic welds to form individual connector units.

* * * * *